US007437854B1

(12) United States Patent
O'Reilly

(10) Patent No.: US 7,437,854 B1
(45) Date of Patent: Oct. 21, 2008

(54) STABILIZER SYSTEM FOR PORTABLE STRUCTURE

(76) Inventor: Sean Joseph O'Reilly, 7019 W. El Cortez Pl., Peoria, AZ (US) 85383

( * ) Notice: Subject to any disclaimer, the term of this patent is extended or adjusted under 35 U.S.C. 154(b) by 934 days.

(21) Appl. No.: 10/840,059

(22) Filed: May 5, 2004

(51) Int. Cl.
*E04F 19/00* (2006.01)
*E02D 5/74* (2006.01)
*A47K 11/02* (2006.01)
*A47K 11/04* (2006.01)

(52) U.S. Cl. ..... 52/27; 52/DIG. 11; 52/155; 4/449; 4/476

(58) Field of Classification Search ..... 52/155, 52/79.1, 545, 530, DIG. 11, 27, 27.5, 34; 4/321, 476, 449, 902, 239; 292/288; 248/154, 248/156, 530
See application file for complete search history.

(56) References Cited

U.S. PATENT DOCUMENTS 227,257 A * 5/1880 Irion ..... 27/20
4,134,474 A * 1/1979 Stavenau et al. ..... 182/187
4,557,478 A * 12/1985 Levine ..... 482/89
4,571,876 A * 2/1986 LeClair ..... 43/17
5,067,428 A * 11/1991 Dickerson et al. ..... 405/1
5,138,901 A * 8/1992 Dabandjian et al. ..... 74/551.8
5,152,564 A * 10/1992 Martineau ..... 292/288
5,337,856 A * 8/1994 Fillers ..... 182/107
5,345,708 A * 9/1994 Loyd ..... 43/21.2
5,464,135 A * 11/1995 Studdiford ..... 224/420
5,622,066 A * 4/1997 Shallis ..... 70/233
5,781,939 A * 7/1998 Bledsoe ..... 4/483
5,987,801 A * 11/1999 Anderson ..... 43/17
6,024,318 A * 2/2000 Barry ..... 242/406
6,083,124 A * 7/2000 Williams ..... 473/421
6,360,571 B1 * 3/2002 O'Neal ..... 70/226
6,502,340 B2 * 1/2003 Stone et al. ..... 40/607.06
6,726,163 B2 * 4/2004 Eppard et al. ..... 248/219.4
6,942,065 B1 * 9/2005 Price ..... 182/187
6,968,986 B1 * 11/2005 Lloyd et al. ..... 224/507
7,121,124 B1 * 10/2006 Whinery ..... 70/38 C
7,194,877 B1 * 3/2007 Cottrell ..... 70/14
2004/0202512 A1 * 10/2004 Smith ..... 405/259.1
2007/0227057 A1 * 10/2007 Holmberg ..... 43/17

* cited by examiner

*Primary Examiner*—Richard E. Chilcot, Jr.
*Assistant Examiner*—Brent W Herring
(74) *Attorney, Agent, or Firm*—Gregory J. Nelson

(57) ABSTRACT

An stabilizer system for a temporary building such as a portable toilet. The stabilizer system has a U-shaped anchor the legs of which are attachably securable to members on the base of the building by means of an elongate rod. The U-shaped anchor extends from a sidewall of the building and at the time of installation may be placed about a permanent upright member such as a utility pole or may be ground staked via holes in the member provided for this purpose.

9 Claims, 2 Drawing Sheets

STABILIZER SYSTEM FOR PORTABLE STRUCTURE

FIELD OF THE INVENTION

The present invention relates to a securement system and more particularly to a stabilizer system for temporary structures such as portable toilets from being tipped over due to occurrences such as weather conditions and vandalism.

BACKGROUND OF THE INVENTION

There are various types of small, portable buildings in use today. One particularly common type of temporary, portable building is the portable toilet. Portable toilets are transported and placed at locations such as construction sites, agricultural fields, concert venues, fairgrounds, athletic events, marathon races and other events where a large number of people congregate for a limited time period and where permanent toilet facilities are not available which will accommodate the increased number of people.

The portable toilet is generally a structure which approximately 4×4 and about 7 feet high. The structure may be made from metal or plastic and includes toilet facilities with a holding tank for waste in which chemicals are placed to treat the waste and reduce odors. Since buildings of this type are small and usually of light weight construction, they are often subject to vandalism and the vagaries of the weather which can cause not only damage to the unit, but also can cause spillage of the waste and chemicals from the holding tank. When such a structure is upended either by vandals, pranksters or by weather conditions such as high winds, the result is an unsightly mess which presents problems of cleaning and sanitizing both the portable structure, as well as the area affected by the spill.

Based on the foregoing, there exists a need for a simple stabilizer or anchor system which will maintain portable buildings in an upright position, preventing or deterring vandalism and securing the unit in an upright position even when subject to high winds.

BRIEF SUMMARY OF THE INVENTION

Briefly, in several embodiments the stabilizer system of the present invention is designed to secure temporary buildings such as portable toilets to existing upright securement structures such as utility poles, fences, framing or any vertically projecting, permanent member that is of a size and strength to provide firm securement. In one embodiment, the system includes an anchor which is generally U-shaped having a pair of spaced-apart legs connected at a bight section. The opposite, distal ends of the legs each define aligned transversely extending bores which receive an elongated rod. The U-shaped anchor is placed around the securement member and extended beneath the portable building. Conventional construction is to support portable buildings or at least a pair of spaced-apart structural members which form a part of the base below the floor. To install the unit, the installer will first drill holes in the existing structural members located on the bottom of the unit and align the drilled holes with a selected pair of bores in the legs. The elongate rod can then be extended through one leg, through the spaced-apart structural members through the opposite leg. One end of the rod has an enlarged head and the opposite end is threaded to receive fasteners such as a nut. The particular bores selected will be determined by the terrain on which the portable building is located and the size and location of the securement structure.

It is generally desirable to install the building unit close to the existing securement structure, such as a utility pole. When installed, the U-shaped anchor member extends around the pole or other upright structure and is secured by the elongate rod to the structural members on the underside of the portable unit.

In the event a suitable upright structure is not available, the U-shaped anchor member can be staked to the ground. To accommodate staking, holes provided in the legs of the anchor near the U-shaped bight. These holes extend vertically through the legs in a use position and are perpendicular to the transverse bores in the distal end of the legs. Conventional sections of rebar having their upper ends bent in a L-shaped configuration may be used to stake the device. The unit may also be provided with a ground stake having a pair of spaced-apart legs joined by a transverse section. The legs are spaced-apart a distance to align with the ground stake holes in the anchor. Once driven into the ground, the projecting ends of the stakes can be covered with suitable caps for safety.

In another embodiment, the stabilizer system comprises a frame having dimensions larger than the "foot print" of the building. The large frame is attached to the lower part or base effectively increasing the size of the base to provide increased resistance to tipping. The frame may be ground staked for additional security.

BRIEF DESCRIPTION OF THE DRAWINGS

The above and other advantages and objects of the present invention will become more apparent from the following description, claims and drawings in which:

DETAILED DESCRIPTION OF THE DRAWINGS

Figure 1:
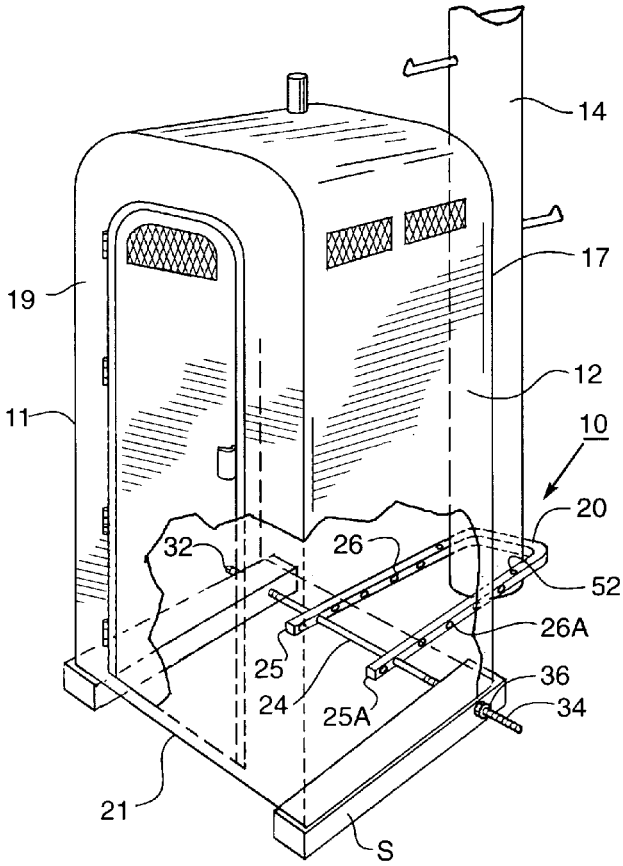
FIG. 1 is a perspective view showing the stabilizer system of the present invention attached to a portable toilet and secured about a utility pole.

Turning now to the drawings, particularly FIG. 1, a portable building 12 is shown temporarily attached to a vertically or upright utility pole 14 by a securement or stabilizer 10 of the present invention. The building 12 is of conventional construction having opposite sidewalls 11, top wall 15, rear wall 17 and front wall 19 which is generally provided with an access door. A horizontal floor 21 extends across the bottom of the unit. Typically the building will contain toilet facilities and a holding tank which receives waste and chemicals. As pointed out above, an unsanitary condition is created in the event the portable building is tipped over either by human intervention or by weather conditions. Accordingly, with the stabilizer system 10 of the present invention the building 12 can be secured or tied to an upstanding structure. The structure may be a utility pole, beam, framing or any other secure, upright, permanent member which is of a size, strength and location to allow the device 10 of the present invention to be placed about the upright member.

Figure 3:
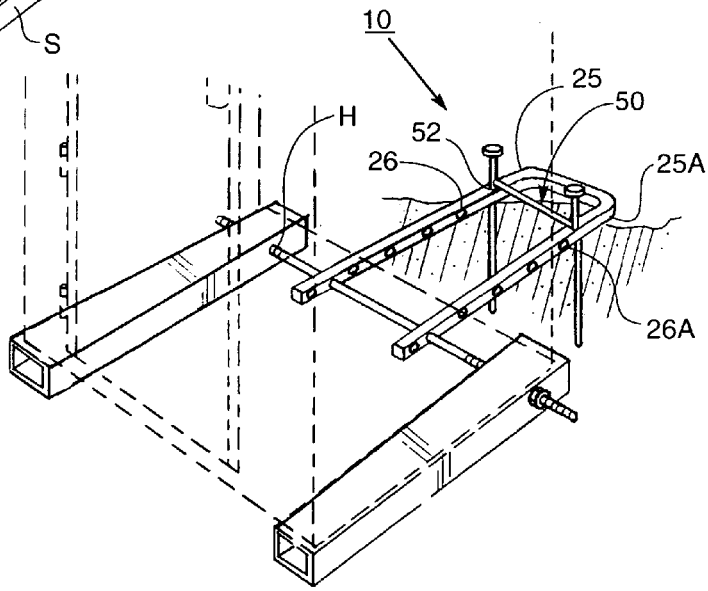
FIG. 3 is a perspective view showing the stabilizer system of the present invention anchored by use of a ground stake.
Figure 2:
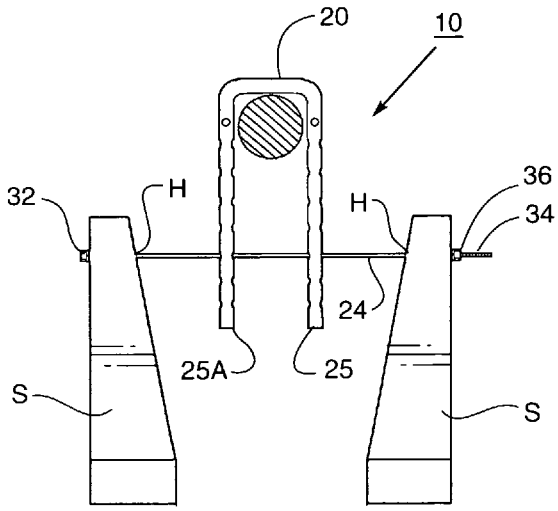
FIG. 2 is a detail view showing the attachment of the stabilizer system of the present invention to the base of a temporary building such as a portable toilet.

The stabilizer system 10 is best seen in FIGS. 1, 2 and 3. The device 10 has an anchor 18 having a pair of spaced-apart legs 25, 25A. Typically the legs are spaced-apart about a distance of about 12 inches. Each of the legs is approximately 3 to 4 feet long and the legs are connected at one end by U-shaped bight 20. The device can be manufactured from any suitable material such as steel tubing or cold rolled steel. Conventional 1" diameter rebar has been found to work for this purpose and facilitates fabrication to the desired U-shape by conventional metal bending techniques. Cold rolled steel is also a preferred material having the necessary strength.

The U-shaped anchor member is secured to the underside of the building by an elongate rod 24. To accommodate attachment, a plurality of spaced-apart holes 26, 26A are provided in the legs 25, 25A. Typically the diameter of the holes is approximately ⅜ of an inch and the holes are axially spaced-apart along each leg a distance of approximately 4" to 6". Holes 26 transversely align with holes 26A to accept insertion of rod 24.

The installer, using a wood bore or similar drill bit, will drill aligned holes H in the support members S underlying the floor. The members S are part of the structure of the building and are located on the underside of the base and are generally plastic or wooden 2"×4"s. The location of the drilled holes will be determined by some extent to the terrain on which the portable toilet is to be located.

Referring to FIGS. 1, 2 and 3, connection of the base to the portable building is shown. The spaced-apart members S are shown and the installer has drilled transverse holes H in each of the members S. Since the terrain on which the building is to be placed is somewhat uneven, the holes H in the members S are spaced a small distance inward from the rear wall 17. If the terrain on which the building is to be positioned is relatively flat, it may be desirable to drill the holes H more toward the center of the members S.

Figure 6:
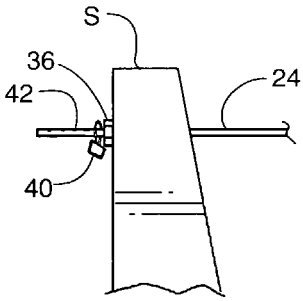
FIG. 6 is a detail view showing the end of the attachment rod secured by a lock.

Once the holes are drilled, the building 12 is positioned adjacent an upright structure, in this case a utility pole 14. The U-shaped anchor 18 is placed around the utility pole with the bight portion and legs extending as shown in FIG. 1. The legs 25, 25A are extended beneath the building and a selected pair of holes 26, 26A in the legs are aligned with the holes H in the members S. Elongate rod 24 has a head 32 on one end and a threaded section 34 on the other. The rod is extended through one of the structural members 30 and through the opposed holes 26, 26A in the leg with the threaded section 34 on the opposite end. The length of the rod is selected so the threaded end 34 projects from one of the members S. The device can then be secured by tightening a nut 36 on the threaded end of the rod. While performing the installation, the installer may find it convenient to use several small sections of framing members, such as 2"×4"s, to temporary elevate the unit to provide access to the drilled holes in the structural member and the pre-drilled holes in the legs of the securement member. For additional security, a small lock 40 may be placed through a selected bore 42 in the end of the rod outward of the nut as seen in FIG. 6.

In some instances, there may not be a suitable upright structure such as a utility pole to which the device can be anchored. In this instance, the anchor 18 can be attached with the U-shaped body member secured between members S by a transversely extending attachment rod, as has been described. The anchor member 18 can then be secured to the ground by use of ground stakes 50 which may be driven into the ground through vertically extending ground stake holes 52 at the proximal end of the anchor 18. The ground stake holes are typically ½ to ⅝ inches in diameter. The device may be staked using conventional rebar such as a section of ½ inch rebar 3 to 4 feet in length, preferably with the upper end bent over so it can be engaged with the legs once fully driven into the ground.

Figure 4:
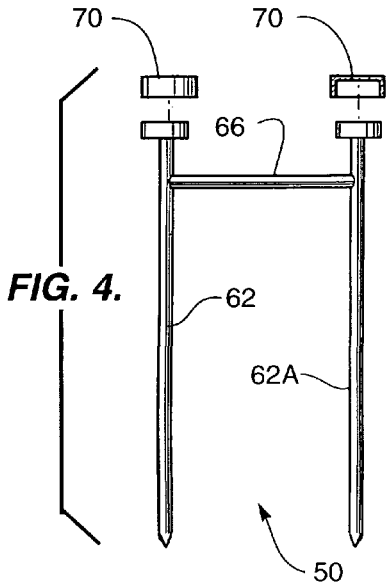
FIG. 4 is a perspective view of an H-shaped ground stake of the type used to secure the device to the ground as shown in FIG. 3.

The device may also be provided with an H-shaped ground stake 50 as shown in FIGS. 3 and 4. The H-shaped ground stake 50 has a pair of spaced-apart vertical legs 62, 62A joined by transverse cross bar 66. Each of the legs is approximately 3 to 4 feet in length and the H-shaped cross member is welded between the legs 62, 62A near the upper end of the legs. Again, the legs may be rebar or suitable steel material. The distal end of the legs can be aligned with the ground stake bores 52 in the anchor and driven into the ground until the cross bar engages the body members, as seen in FIG. 3. The upper, projecting ends can be covered with plastic caps 70 for safety purposes to prevent injury in the event someone should come into contact or fall on the ground stakes.

Figure 5:
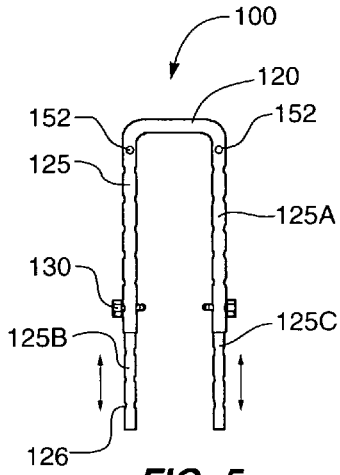
FIG. 5 is a perspective view of an alternate embodiment of the stabilizer system of the present invention in which the legs of the anchor are telescopically adjustable in length.

In FIG. 5, an alternate embodiment of the stabilizer device is shown generally designated by the numeral 100. Again, the device has a pair of legs 118, 118A which are joined by a U-shaped bight section 120. The legs are tubular and each receive a telescopic leg section 125B and 125C. The telescopic leg sections are slidable within the tubular section of the member. Thus, the overall length of the device can be selectively adjusted. Once the desired length is established, the telescopic legs can be secured relative to the U-shaped member by placing selected holes in the member in registry and securing them by a fastener such as a nut and bolt 130. The U-shaped member is provided with bores 152 for receipt of ground stakes. The distal end of the telescopic legs 125, 125A are provided with a plurality of aligned transverse holes 126, 126A for receipt of the elongate attachment rod, such as rod 24, as described above.

The anchor, rods and fasteners can be suitably coated with a primer and anti-rusting agent. Tests on the system, as described above, utilizing a stabilizing member, as shown in FIG. 1, having legs approximately 25 inches long and, when secured to a utility pole, have shown that portable toilets of conventional design will stay upright in winds in excess of 40 mph. A portable toilet secured with the device, as described above, will prevent most instances of vandalism where vandals attempt to tip over the portable toilet. Of course, the device cannot protect against extreme vandalism such as vehicular vandalism or extreme weather conditions such as hurricane velocity winds.

Figure 7:
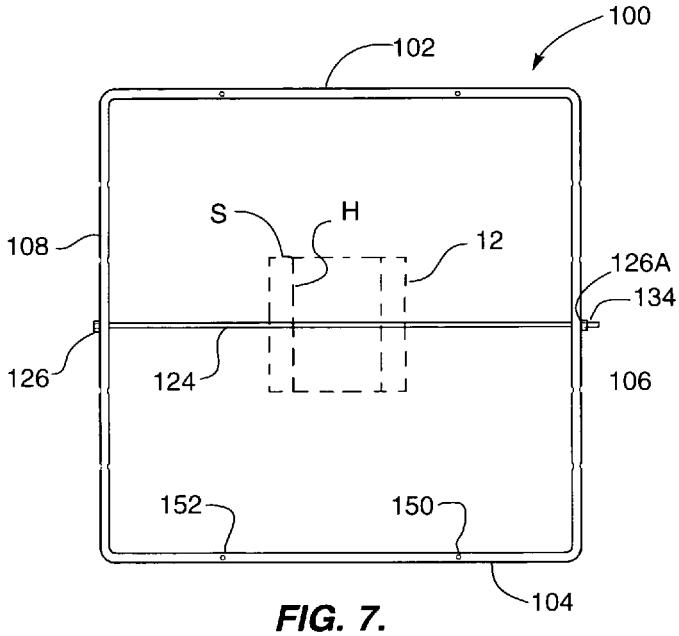
FIG. 7 is a plan view of yet another embodiment of the stabilizer system of the present invention with the base of a portable building being shown in dotted lines.

In FIG. 7, another embodiment indicated by the numeral 100 is shown. The building 12 and support members S are shown in dotted lines. The stabilizing device 100 has a frame-like structure which may be flat steel stock or tubing such as 1" tubing. The frame is generally rectilinear having legs 10, 104, 106 and 108 joined at intersecting corners by connector or by welding. Horizontal holes 126, 126A are provided in opposite legs 106, 108 and are in alignment at a center location in the legs. Holes 150 extend vertically through the legs at spaced locations to accept a ground stake 150.

The oversize frame is secured to the base members H by a rod 124 extending through legs 108 and 106 and through bored holes H in members S. The rod is secured by a nut 136 and a lock if necessary.

The large frame extends around the periphery of the building 12 spaced at least several feet outward of the sidewalls on the ground. The size of the frame will make it much more difficult to tip over the structure. The addition of ground staking will further stabilize the building 12.

The stabilizer system of FIG. 7 is preferred for use on flat, even surfaces such as asphalt and cement and may be used without staking or where upright structures to which a stabilizing device may be attached are not available.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. A stabilizer system for a ground supported structure having generally parallel base members spaced-apart a predetermined distance defining opposed aligned bores, said system comprising:

(a) a generally flat, U-shaped anchor member having first and second legs joined at their proximal end at a bight section and having distal ends, said legs being spaced-apart a distance less than the predetermined distance between said base members with legs positionable on a ground surface intermediate said base members with said bight section projecting outwardly of said portable structure for securement, said anchor defining at least one vertically extending hole for receipt of a ground stake;

(b) the distal ends of said first and second legs defining aligned apertures;

(c) an attachment rod having opposite ends insertable through the bores in said base members and the apertures in said legs, said rod having sufficient length to project outward of said base members; and (d) said rod having a head on one end engaging one of said base members and a nut on the other end engaging the other base member.

2. The stabilizer system of claim 1 wherein said legs define a plurality of spaced-apart apertures.

3. The stabilizer system of claim 1 further including taking means for securing said anchor member to the ground.

4. The stabilizer system of claim 1 wherein said staking means comprises bores in said members.

5. The stabilizer system of claim 1 wherein said fastener is an elongate rod having a threaded end receiving a nut.

6. The stabilizer system of claim 1 wherein said legs are telescopically adjustable in length.

7. The stabilizer system of claim 1 wherein said U-shaped member is fabricated from steel.

8. The stabilizer system of claim 1 wherein said steel is rebar.

9. The stabilizer system of claim 1 wherein said frame is provided with bores for receiving ground stakes.

* * * * *